United States Patent [19]

Panichello et al.

[11] Patent Number: 5,031,239

[45] Date of Patent: Jul. 16, 1991

[54] FINGER PROTECTOR FOR BASEBALL GLOVE

[75] Inventors: Joseph A. Panichello; Robert C. Williams, III, both of Raleigh, N.C.

[73] Assignee: TranSports, Inc., Raleigh, N.C.

[21] Appl. No.: 565,144

[22] Filed: Aug. 10, 1990

[51] Int. Cl.[5] ..... A41D 13/10

[52] U.S. Cl. ..... 2/19; 2/21; 2/161 A; 2/163

[58] Field of Search ..... 2/19, 21, 159, 160, 2/161 R, 161 A, 163

[56] References Cited

U.S. PATENT DOCUMENTS

| | | | |
|---|---|---|---|
| 1,562,176 | 11/1925 | Latina | 2/19 |
| 2,778,023 | 1/1957 | Tompkins | 2/19 |
| 3,229,690 | 1/1966 | Scholl | 2/21 |
| 3,602,915 | 9/1971 | Collins | 2/19 |
| 3,721,996 | 3/1973 | Nadorf | 2/19 |
| 4,665,561 | 5/1987 | Aoki | 2/19 |
| 4,853,975 | 8/1989 | Clevenhagen | 2/19 |
| 4,896,376 | 1/1990 | Miner | 2/19 |

*Primary Examiner*—Werner H. Schroeder
*Assistant Examiner*—Amy Brooke Vanatta
*Attorney, Agent, or Firm*—Rhodes, Coats & Bennett

[57] ABSTRACT

The present invention entails a finger protector adapted to be secured to the backside of a baseball glove for receiving the normally exposed finger of the glove hand. In particular, the finger protector of the present invention is designed to be secured adjacent a finger opening formed in the back side of the glove through which the player's index finger extends. The finger protector of the present invention includes a relatively hard outer housing and internal padding material and wherein the housing and internal padding material form a finger receiving area that protects the player's finger when the finger is inserted within the housing.

9 Claims, 2 Drawing Sheets

FINGER PROTECTOR FOR BASEBALL GLOVE

FIELD OF THE INVENTION

The present invention relates to baseball gloves and more particularly to a finger protector adapted to be secured to the baseball glove for receiving the index finger of the glove hand of a player.

BACKGROUND OF THE INVENTION

Typically, it is a common practice for baseball players to extend a finger, usually the index finger, from their baseball glove to give the finger additional padding and protection from the hard impact of catching a thrown or hit baseball or softball. However, this practice exposes the baseball or softball player's finger to potential injury and damage from any number of sources. For example, it is not uncommon for a baseball or softball player's exposed index finger to be hit by a thrown or hit baseball or softball, or for the exposed index finger to be impacted by sliding base runners or other impact source. Thus, the problem with exposing the index finger of the glove hand is that the index finger is then exposed to serious potential injury. Therefore, there is and continues to be a need for some means to protect the exposed index finger of a baseball player's glove hand.

SUMMARY AND OBJECTS OF THE INVENTION

The present invention entails a finger protector for a baseball glove that is designed to attach to the baseball or softball glove adjacent a finger opening formed in the glove that permits a player to extend a selected finger from the glove such that the finger is exposed about the back side of the glove. The finger protector of the present invention entails an outer housing that includes a soft and comfortable inner padding structure, and means for attaching the housing to the baseball glove adjacent the finger opening of the glove. There is defined inside the outer housing a finger receiving opening that enables the baseball player to extend his finger, usually the index finger, from the glove into the finger receiving opening defined within the outer housing of the finger protector.

It is therefore an object of the present invention to provide a finger protector for a baseball glove for protecting an exposed finger that normally extends from the back side of the glove.

Another object of the present invention resides in the provision of a finger protector or baseball glove that can be easily attached to an existing glove.

A further object of the present invention resides in the provision of a finger protector that is slightly curved so as to conform to the natural bend or shape of a player's finger when disposed on the outside of a baseball glove.

Still a further object of the present invention resides in the provision of a finger protector of the character referred to above that includes internal padding for protecting the finger from hard impact internally within the finger protector itself.

Other objects and advantages of the present invention will become apparent and obvious from a study of the following description and the accompanying drawings which are merely illustrative of such invention.

DETAILED DESCRIPTION OF THE INVENTION

Figure 1:
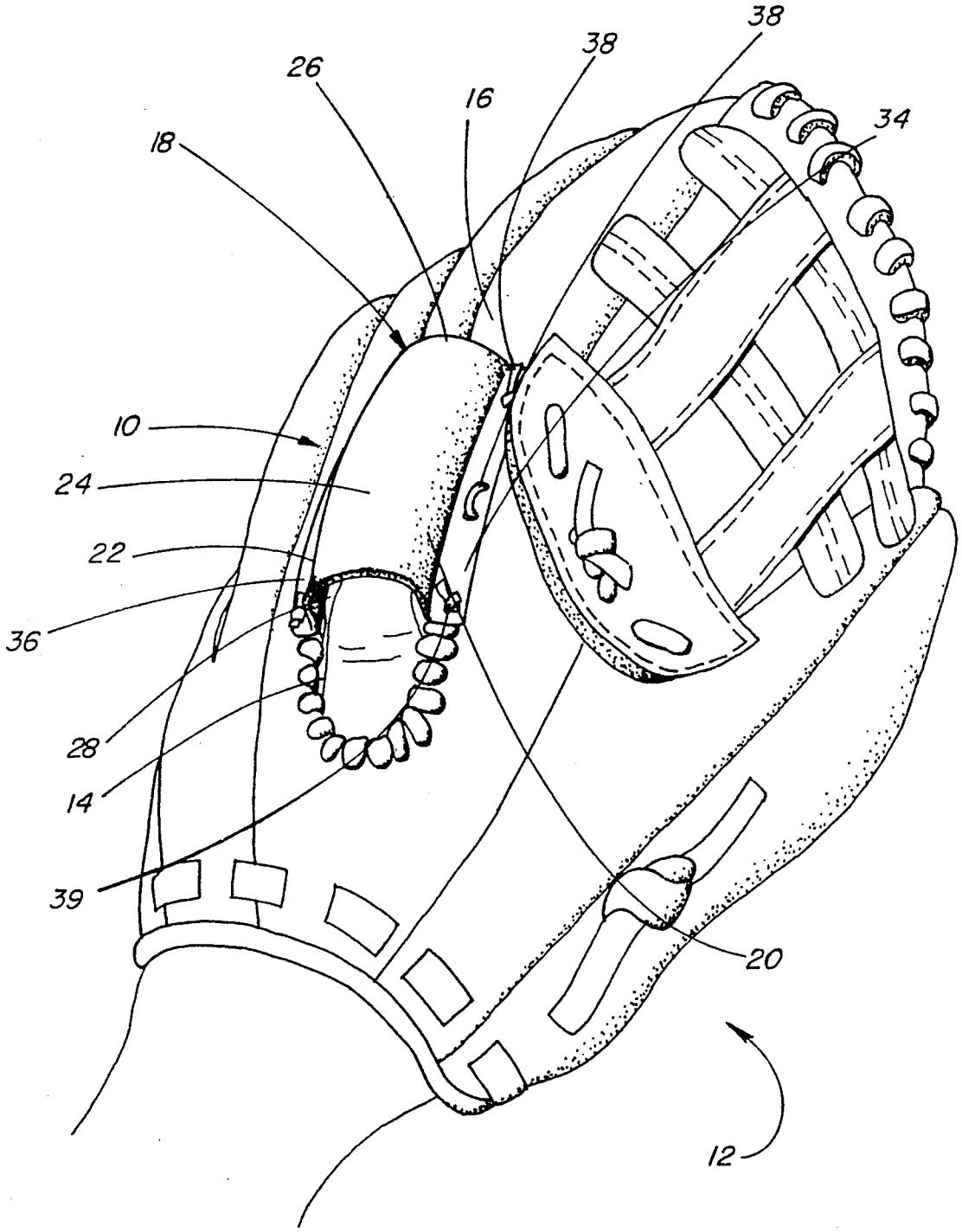
FIG. 1 is a perspective view illustrating the finger protector of the present invention attached to a baseball glove.
Figure 2:
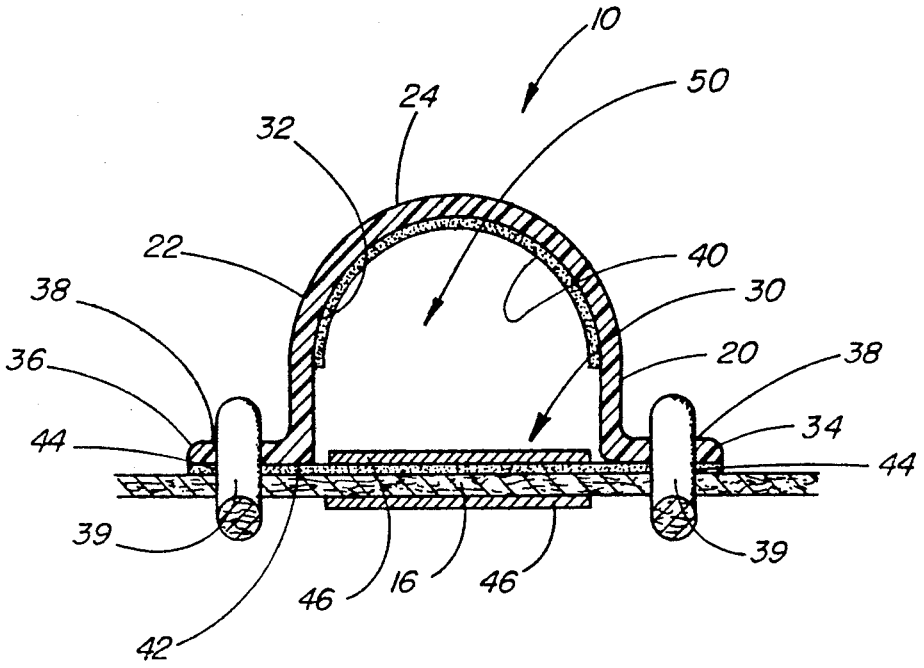
FIG. 2 is a transverse sectional view of the finger protector secured to a portion of the baseball glove.
Figure 3:
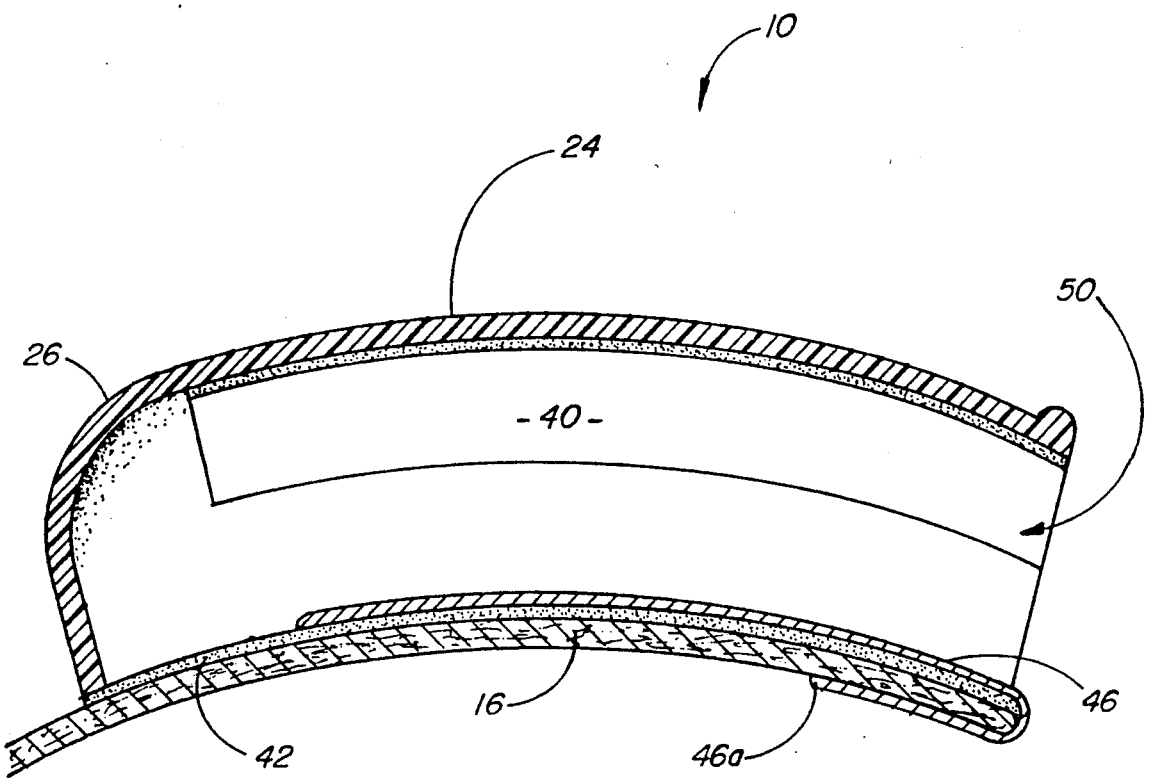
FIG. 3 is a longitudinal sectional view of the finger protector of the present invention.

With further reference to the drawings, the finger guard of the present invention is shown therein and indicated generally by the numeral 10. As seen in the drawings, finger guard 10 is secured to a baseball glove indicated generally by the numeral 12. Baseball glove 12 can be any conventional baseball glove that has the capability of permitting the player to expose a selected finger, particularly the index finger. Viewing baseball glove 12 it is seen that the same includes index finger opening 14 that permits the player to extend the index finger of the glove hand therethrough such that during the course of play the player's index finger extends through the finger opening 14 and is exposed about the back side of the glove. Extending above finger opening 14 and forming a part of the glove 12 is a leather panel segment 16. As will be understood from subsequent portions of this disclosure, the leather panel segment 16 will underline the finger guard 10 when the same is secured to the back side of the glove 12.

Turning now to a detailed discussion of the finger guard 10 it is seen that the same includes an outer housing that is indicated generally by the numeral 18. The outer housing comprises a pair of sides 20 and 22 and a curved top portion 24 that extends between the sides 20 and 22. Formed about one end of the outer housing 18 is a closed rounded nose 26. Formed about the opposite end of the outer housing 18 is a finger opening 28. As seen in the drawings, the outer housing structure 18 is generally u-shaped and includes an open bottom 30 that is formed opposite the curved top 24. As seen in the drawings, in an attached mode, the open bottom 30 fits flush against the back of the baseball glove 12 and particularly the panel area 16 formed above the finger opening 14 in the glove.

It is appreciated that the outer housing 14 includes an outer wall structure and it also includes an inner wall structure that is referred to by the numeral 32.

Extending adjacent the open bottom 30 is a pair of flange rails 34 and 36, with each flange rail including spaced lace openings 38 formed therein. Lace openings 38 are designed to receive leather type laces 39 that secure the finger guard 10 to the baseball glove 12.

Also forming a part of the finger guard 10 is various padding materials that are utilized interiorly of the outer housing 18 and about the bottom area. Viewing this padding material in more detail, it is seen that the same includes an upper foam padding or panel 40 that is secured to the inner wall 32 and particularly to the underside of top 24. This upper foam padding panel 40 is of the type that includes a sticky or adhesive surface that enables the same to be quickly and easily secured to the inner wall 32 of the outer housing 18.

Secured to the lower open bottom portion of the housing 18 is a lower foam padding panel 42 that includes a series of lace openings 44 formed about the periphery thereof. Lower foam padding panel 42 is designed to be secured flush adjacent the flange rails 34 and 36 and to effectively form a bottom portion for the finger guard 10. The upper surface of lower foam padding panel 42 assumes a sticky or adhesive quality and is adapted to receive a leather strip 46. Note that the leather strip 46 is elongated and includes a taped adhesive end 46*a*. The leather strip 46 is secured to the top surface of lower foam padding panel 42 through the sticky or adhesive nature of the upper surface of the lower foam padding panel 42. It is seen that the leather strip 46 extends across the upper surface of the lower foam padding panel 42 and turns around the edge of the finger opening 14 of the baseball glove 12 and then extends underneath the glove panel area 16 a selected distance. The lowermost segment of the leather strip 46 is secured to the glove panel area 16 by simply removing the protective tape found on the tape end 46 of the strip so as to expose a sticky or adhesive area formed on the end of the strip. This sticky or adhesive area is brought into engagement with the underside of the leather panel 16 resulting in the leather strip being secured to the glove.

Defined internally within the outer housing 18 is a finger receiving area that is indicated generally by the numeral 50. It is appreciated that the finger receiving area 50 is defined interiorly of the outer housing and between the upper foam panel 40 and the leather strip 46.

As seen in the drawings, the finger guard 10 and particularly the outer housing 18 is slightly arcuately shaped so as to generally conform to the normal shape of the player's finger when disposed outside of the finger opening 14 formed in the baseball glove 12.

To secure the finger guard 10 to the baseball glove 12, the open bottom area 30 of the housing 18 is disposed directly adjacent the panel area 16 formed above the finger opening 14 within the glove 12. By utilizing lace strips 39 and threading the lace strips 39 through the lace openings 38 in the flange rails 34 and 36 and continuing to lace the lace strips 39 into and through appropriate areas of the glove, enables one to secure the entire finger guard 10 to the glove 12.

In use, the finger guard 10 is attached such that the finger opening portion 28 thereof lies adjacent to and above the finger opening 14 formed in the glove 12. The player's finger, the index finger usually, can be inserted into the finger receiving area 50 which is defined by the padding material and the outer housing 18. Once the player's index finger has been inserted within that finger receiving area 50, then the finger is protected from any contact and any possible damage due to impact. In addition, the padding material formed interiorly within the outer housing 18 serves to protect the finger and to soften any impact between the finger and the finger guard due to an impact being directed against the finger guard 10.

From the foregoing specification and discussion, it is appreciated that the finger guard 10 of the present invention provides substantial and significant protection to a baseball player's index glove finger or any other finger that the player may choose to extend from the glove and into the finger receiving area 50.

In the foregoing specification, a baseball glove 12 has been referred to. However, it should be understood that the present finger protector can also be utilized in conjunction with softball gloves.

The present invention may, of course, carried out in other specific ways than those herein set forth without parting from the spirit and essential characteristics of the invention. The present embodiments are, therefore, to be considered in all respects as illustrative and not restrictive, and all changes coming within the meaning and equivalency range of the appended claims are intended to be embraced therein.

What is claimed is:

1. A finger guard attachment for a ball glove having a finger opening in a backside thereof communicating with a hand receiving pocket of the glove comprising:

(a) a generally u-shaped housing adapted to mount to the backside of the ball glove adjacent the finger opening so as to define a finger receiving cavity for enclosing and protecting an exposed finger projecting from the finger opening in the ball glove, said u-shaped housing having an open end for insertion of the finger into the finger receiving cavity, and an elongated main body portion extending beyond the end of the exposed finger and which terminates in a closed end;

(b) padding material secured to the inside of the u-shaped housing; and (c) means for attaching the u-shaped housing to the backside of the ball glove adjacent the finger opening.

2. The finger guard protector of claim 1 wherein the u-shaped housing includes side flange portions that normally rest adjacent the glove, and wherein the means for attaching the u-shaped housing to the glove includes lace means that extend through openings formed within the flanges and wherein the lace means is secured to the baseball glove.

3. The finger guard of claim 1 wherein said u-shaped housing is slightly curved so as to conform generally to the shape of a player's finger to be inserted within the finger guard.

4. The finger guard of claim 1 wherein the u-shaped housing includes a generally u-shaped elongated channel that includes a pair of opposite sides and a top portion extending between the opposite sides such that there is defined an open bottom lying opposite the top and wherein the bottom of the u-shaped housing rests adjacent the baseball glove when the finger guard is attached thereto.

5. The finger guard of claim 4 wherein the padding material includes an upper pad panel secured to the top of the u-shaped housing about the interior of the u-shaped housing.

6. The finger guard of claim 5 wherein the padding material further includes a lower foam pad panel secured adjacent the open bottom of the u-shaped housing and as such generally encloses the u-shaped housing such that the player's finger is confined within the u-shaped housing and between the upper and lower foam pads.

7. The finger guard of claim 6 further including a soft strip material secured across a top side of the lower foam pad panel and extending around and underneath the lower foam pad panel to where the strip material is attached to the baseball glove.

8. A baseball glove finger protector for attachment to a baseball glove and for receiving and protecting a baseball player's exposed finger extending from a finger opening in the baseball glove, comprising:

(a) a housing structure adapted to be mounted to the glove adjacent the finger opening of the baseball glove;

(b) said housing structure including an elongated main body portion defining a finger receiving cavity for enclosing and protecting an exposed finger extending from the finger opening in the baseball glove, and an opening in the main body portion for insertion of the finger into the finger receiving cavity, wherein the main body portion is of sufficient length to cover substantially the entire length of the exposed finger;

(c) attachment means for securing the finger protector and housing to the baseball glove in an area adjacent the finger opening such that a normally exposed finger of the baseball player can be inserted into a finger receiving opening formed in the housing of the finger protector so as to protect that finger during the course of a baseball game.

9. The baseball glove finger protector of claim 8 wherein the housing structure includes an interior wall that is formed by a pair of sides and a top and wherein there is provided padding means disposed about the interior wall of the housing structure for providing a relatively soft impact area for the baseball player's finger confined within the finger protector.

* * * * *